US006997493B2

(12) United States Patent
Beach

(10) Patent No.: US 6,997,493 B2
(45) Date of Patent: Feb. 14, 2006

(54) LOCKABLE OVERSHOT

(75) Inventor: Andrew Beach, Mitchell Park (AU)

(73) Assignee: Boart Longyear Pty Ltd, Mitchell Park (AU)

( * ) Notice: Subject to any disclaimer, the term of this patent is extended or adjusted under 35 U.S.C. 154(b) by 0 days.

(21) Appl. No.: 10/477,161

(22) PCT Filed: May 9, 2002

(86) PCT No.: PCT/AU02/00580

§ 371 (c)(1),
(2), (4) Date: May 18, 2004

(87) PCT Pub. No.: WO02/092960

PCT Pub. Date: Nov. 21, 2002

(65) Prior Publication Data

US 2004/0195852 A1 Oct. 7, 2004

(30) Foreign Application Priority Data

May 11, 2001 (AU) ..... 43854/01

(51) Int. Cl.
*E21B 31/20* (2006.01)

(52) U.S. Cl. ..... 294/86.27; 294/86.29

(58) Field of Classification Search .. 294/86.25–86.33, 294/86.3, 19.1, 106; 175/254
See application file for complete search history.

(56) References Cited

U.S. PATENT DOCUMENTS 474,080 A * 5/1892 Bullock ..... 175/239
1,719,144 A * 7/1929 Stokes et al. ..... 294/86.2
1,738,789 A * 12/1929 Newkirk ..... 294/86.27
2,296,397 A * 9/1942 Muhlbach ..... 294/86.18
2,410,262 A * 10/1946 Breaux ..... 294/86.17
2,507,127 A * 5/1950 True ..... 294/88
3,758,145 A * 9/1973 Kinley ..... 294/86.29
3,930,679 A 1/1976 Anderson et al.

(Continued)

FOREIGN PATENT DOCUMENTS

GB 2341623 3/2000

(Continued)

*Primary Examiner*—Kathy Matecki
*Assistant Examiner*—Esther O. Okezie
(74) *Attorney, Agent, or Firm*—Clayton R. Johnson

(57) ABSTRACT

Lockable overshot (10) includes an elongated body (12), lifting dogs **(14*a*, 14*b*) and a locking sleeve (16). Ends (18) of the lifting dogs (14) are configured for latching a conventional spearhead point therebetween. The locking sleeve (16) is retained on the body (12) and is provided at one axial end with a circumferential wall (66) and two diametrically opposed gaps (68). The locking sleeve (16) is rotatable on the body (12) between a locked state preventing ends (18) of the lifting dogs from pivoting away from each other to release a previously latched spearhead point, and an unlocked state where the locking sleeve (16) allows the lifting dogs (14) to move so that the ends (18) can be pivoted away from each other to release a previously latched spearhead point. In this regard, the locking sleeve (16) is provided at one axial end with a circumferential wall (66) provided with a pair of diametrically opposed gaps (68). When the locking sleeve (16) is in the locked state, the wall (66) is disposed inside or between ends (56) of the lifting dogs (14). This prevents the ends (18) of the lifting dogs from pivoting away from each other. When in the unlocked state, the gaps (68) register with the ends (56) of the lifting dogs (14) so that the ends (56) can be pivoted toward each other thereby pivoting the ends (18)** away from each other to release a previously latched spearhead point.

12 Claims, 4 Drawing Sheets

U.S. PATENT DOCUMENTS 4,004,835 A * 1/1977 Taylor ..... 294/86.29
4,093,294 A 6/1978 Taylor
4,254,983 A 3/1981 Harris
4,515,403 A 5/1985 Cheek
4,834,198 A * 5/1989 Thompson ..... 175/244
6,019,181 A * 2/2000 Soinski et al. ..... 175/58
6,089,335 A * 7/2000 Able ..... 175/246
6,564,885 B1 * 5/2003 Attwater ..... 175/235
6,820,703 B1 * 11/2004 Borg ..... 175/58

FOREIGN PATENT DOCUMENTS

RU 2124111 6/1997
SU 962583 10/1982

* cited by examiner

LOCKABLE OVERSHOT

FIELD OF THE INVENTION

The present invention relates to a lockable overshot, typically, though not exclusively, for use in a wireline spearhead system for lowering and retrieving core barrels and other tools and equipment from a downhole location.

BACKGROUND OF THE INVENTION

A typical overshot comprises a tubular body in which a pair of lifting dogs is pivotally mounted. The lifting dogs pivot about a pin which attaches the lifting dogs to the body. A first end of the lifting dogs is adapted for catching a spearhead point therebetween. A spring is disposed between the second opposite ends of the lifting dogs for biasing the first ends toward each other to a capture position where a spearhead point can be caught. The bias of the spring holds the first ends of the lifting dogs together about a caught spearhead point.

In order to release a captured spearhead point an operator pushes the second ends of the lifting dogs together against the bias of the spring thereby spreading the first ends of the lifting dogs and releasing the spearhead point. For safety and efficiency reasons it is critical that the lifting dogs do not accidentally or prematurely release a caught spearhead point. For example when retrieving a core barrel from a hole using an overshot, serious injury or death can occur to an operator if the core barrel becomes accidentally released from the overshot while the overshot is being suspended near the top of a drill rig. Similarly, very expensive equipment can be lost downhole if it becomes detached from an overshot.

SUMMARY OF THE INVENTION

It is an object of the present invention to provide a lockable overshot in which the possibility of the lifting dogs accidentally or prematurely releasing a caught spearhead point is reduced.

According the present invention there is provided a lockable overshot including at least:

an elongated body;

at least two lifting dogs pivotally mounted to said body, said ling dogs having respective first ends configured for latching a spearhead point therebetween, said first ends pivotally moveable toward each other to a latched position wherein a spearhead point is latched therebetween and pivotally moveable away from each other to a release position where a latched spearhead point is released; and, a locking sleeve retained on said body and switchable between: a locked state where said locking sleeve locks said lifting dogs in said latched position and, an unlocked state where said locking sleeve allows said lifting dogs to move to said release position.

Preferably said lifting dogs have respective second ends opposite said first ends and said lifting dogs are pivotally mounted at a location intermediate said first and second ends to said elongated body, and at least a portion of said locking sleeve is disposed inside said second ends when in said locked state.

Preferably said locking sleeve is rotatably retained on said elongated body and is switched between said locked state and said unlocked state by rotating said locking sleeve about a longitudinal axis of said elongated body.

Preferably said locking sleeve is provided at one axial end with a circumferential wall formed with a gap for each of said lifting dogs wherein when in said locked state said wall is located inside said respective second ends and when in said unlocked state said second ends are located in said gaps.

Preferably said lockable overshot further includes détente means for releasably holding said locking sleeve selectively in said locked and unlocked states.

Preferably said détente means includes a biased locking ball extending from an outer surface of said elongated body and first and second recesses formed in said locking sleeve for partially receiving said locking ball, said first recess disposed to register with said locking ball when said locking sleeve is in said locked state and said second recess disposed to register with said locking ball when said locking sleeve is in said unlocked state.

In one embodiment said circumferencial wall is of constant outer diameter.

In an alternate embodiment said circumferential wall is formed with a reducing outer diameter in a direction toward said lifting dogs.

Preferably said locking sleeve is further provided with a shoulder of constant outer diameter adjacent said circumferential wall on a side distant said lifting dogs.

Preferably said first and second recesses are in the form of axially extending slots.

Preferably said lockable overshot further includes bias means for biasing said locking sleeve axially in a direction toward said lifting dogs.

BRIEF DESCRIPTION OF THE DRAWINGS

An embodiment of the present invention will now be described by way of example only with reference to the accompanying drawings in which.

DETAILED DESCRIPTION OF PREFERRED EMBODIMENTS

Figure 1:
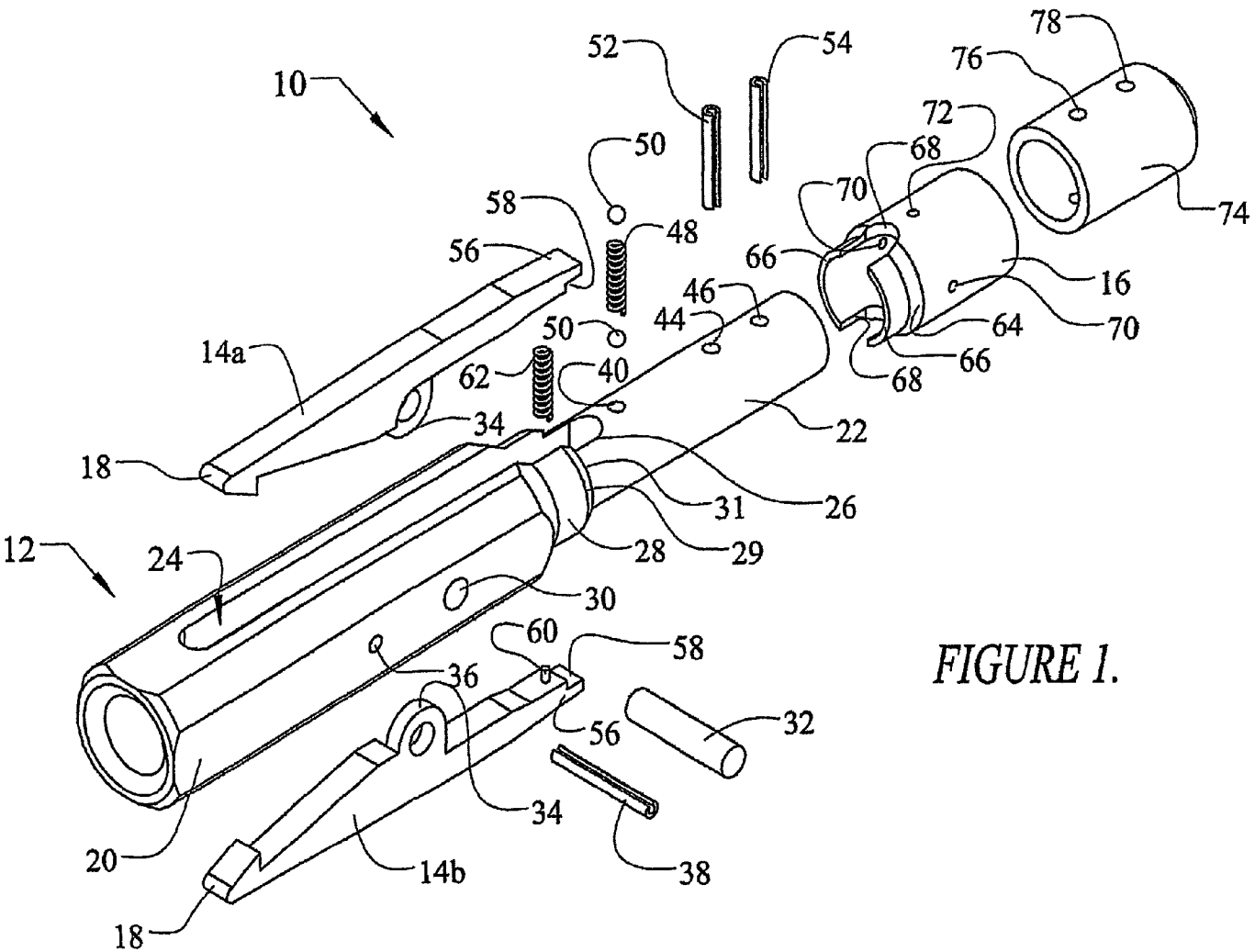
FIG. 1 is an exploded view of an embodiment of the lockable overshot.
Figure 2:
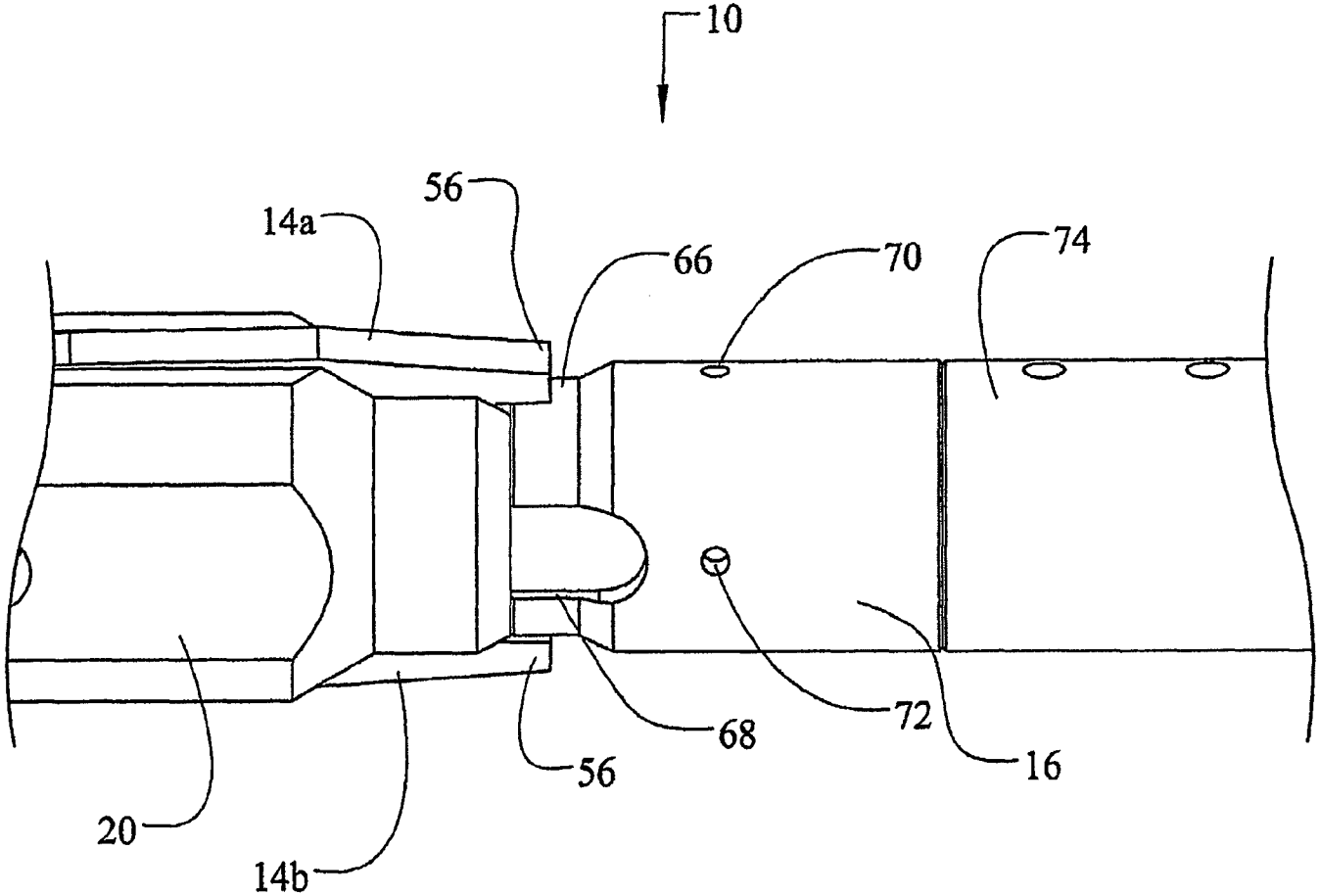
FIG. 2 is a schematic representation of the lockable overshot when in a locked state.
Figure 3:
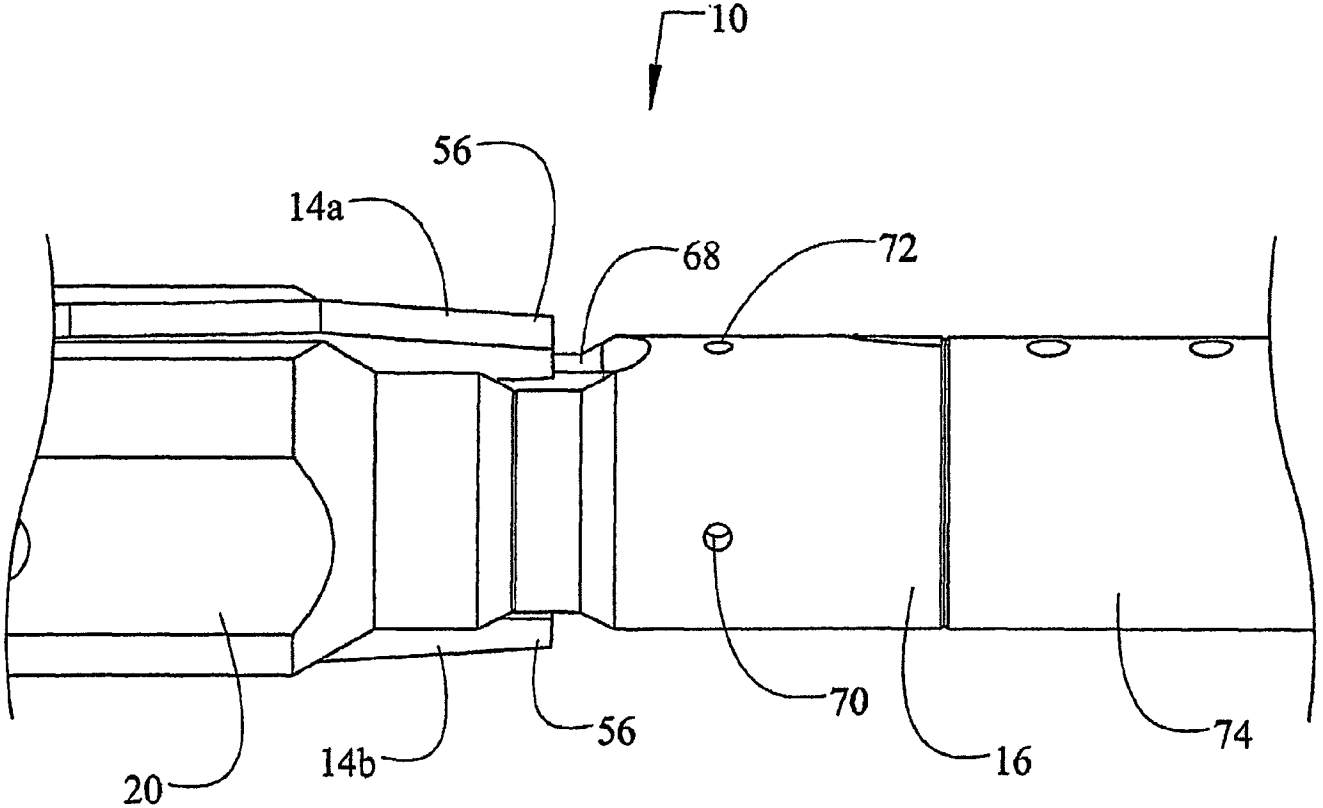
FIG. 3 is a representation of the lockable overshot when in an unlocked state; and, FIG. 4 is a schematic representation of a second embodiment of the lockable overshot.

Referring to FIGS. 1–3 of the accompanying drawings, the lockable overshot 10 includes an elongated body 12, lifting dogs 14*a* and 14*b* (hereinafter referred to in general as "lifting dogs 14") and a locking sleeve 16. The lifting dogs 14 are pivotally mounted to the body 12 and are provided with respective first ends 18 configured for latching a spearhead point therebetween. To this end, the lifting dogs 14 are of a substantially conventional configuration in which each first end 18 is provided with a hook-like formation which catches beneath a spearhead point (not shown). The locking sleeve 16 is retained on the body 12 and is switchable to locked state where the locking sleeve 16 locks the lifting dogs in the latched position preventing them from pivoting away from each other. In this embodiment the sleeve 16 or at least a portion thereof is seated between or inside the lifting dogs 14 to prevent them from pivoting to the ends 18 apart sufficiently to allow a latched spearhead point to be released. In this way, the overshot 10 is positively locked on to a spearhead point and, except for a material failure, can not be released therefrom. This position is depicted in FIG. 2. The locking sleeve 16 can be switched by an operator to an unlocked state where it is disengaged from the lifting dogs 14 allowing the ends 18 to be pivoted away from each other in a convention manner to a released position (shown in FIG. 3) where a previously caught spearhead point can be released from between the lifting dogs 14 in a conventional manner.

Looking at the components of the overshot 10 in more detail, it can be seen that the body 12 includes a hollow tubular lower portion 20 to which the lifting dogs 14 are pivotally mounted, and an integral reduced diameter upper portion 22. An elongated transversely extending slot 24 is formed through the body 12. While a majority of the length of the slot 24 is in the lower portion 20, an upper end 26 of the slot 24 is formed in the upper portion 22. The slot 24 provides room for the lifting dogs 14 to pivot as well as facilitating the assembly of the lifting dogs 14 into the body 12. The outer surface of the lower portion 20 is of an octagonal section while the upper portion 22 is formed with a circular section. An upper end of the lower portion 20 tapers to an intermediate portion 28 of the body which is formed of a constant diameter. The portion 28, is provided with a tapered surface 29 leading to a stepped face 31 which extends to the upper portion 22.

Extending radially through the lower portion 20 transverse to the slot 24 is a hole 30 for receiving a pivot pin 32 which pivotally mounts the lifting dogs 14 to the body 12. In this regard, the pivot pin 32 passes through respective eyelets 34 formed intermediate the length of each of the lifting dogs 14. A second smaller diameter hole 36 is formed through the body 12 parallel to the hole 30 on the side opposite the upper portion 22. The hole 36 seats a spring pin 38 which is disposed between the lifting dogs 14*a* and 14*b* and acts to limit the degree by which the ends 18 can pivot toward each other. When the lifting dogs 14 are in the latched position, they both bear on opposite sides of the spring pin 38.

The upper portion 22 is formed with radially extending through holes 40, 44 and 46, each of these holes extend transversely to the holes 30 and 36. The hole 40 houses a spring 48 and, on opposite side thereof respective locking balls 50 which together form part of a détente.

The hole 40 is of a diameter larger than the diameter of the locking balls 50. The holes 44 and 46 accommodate spring pins 52 and 54. In addition to their function as explained below, the pins 52, 54 also facilitate attachment of the overshot to a wireline cable, as is known in the art.

Second ends 56 of the lifting dogs 14 are formed with respective rebates 58 which face each other. As seen most clearly in FIG. 2, in the assembled overshot 10, the ends 56 extend axially beyond the intermediate portion 28 and stepped face 31 of the body 12, and by virtue of the rebates 58, are spaced radially beyond the surface of the upper portion 22.

Inwardly directed locating pins 60 are provided at the ends 56 inboard of the rebate 58 for seating opposite ends of a compression string 62. The compression string 62 is configured to bias the latching dogs 14 so that the ends 18 are biased toward the capture position.

The locking sleeve 16 is in the form of a tube of an inner diameter slightly greater than the outer diameter of the upper portion 22 so that the locking sleeve 16 can rotate about the upper portion 22. A lower portion of the locking sleeve 16 is provided with a tapered surface 64 of reducing diameter leading to constant diameter circumferential wall 66. The wall 66 is provided with diametrically opposed U-shaped gaps or cut-outs 68. Two first recesses in the form of radially extending holes 70 are formed in the locking sleeve 16 at locations that can register with the position of the locking balls 50 when the sleeve 16 is in the locked state. Two second recesses 72 (only one shown) are also formed in the locking sleeve 16 at positions that can register with the locking balls 50 when the sleeve 16 is in the unlocked state. The holes 70 and 72 are of a diameter less than the diameter of the locking balls 50, in this way the sleeve 16 acts to retain the locking balls 50 in the upper portion 22. Thus the combination of the spring 48, balls 50 and holes 70, 72 act as a détente.

The locking sleeve 16 is retained on the body 12 by a retaining member 74 which sits on the upper portion 22 behind the locking sleeve 16. The retaining member 74 is in the form of a sleeve and provided with two pairs of holes 76 and 78 which are positioned to register with the holes 44 and 46 and through which the spring pins 52 and 54 pass to attach the retaining member 74 to the body 12.

The unlocked state of the locking sleeve 16 is characterised by the gap or U-shaped cut-out 68 registering with the upper end 26 of the slot 24, and the ends 56 of the lifting dogs. In this configuration, the ends 56 of the lifting dogs 14 are able to move through the gaps 68. Additionally, the holes 72 are in alignment with the holes 40 in which case the locking balls 50 partially extend into the holes 72 releasably holding the locking sleeve 16 in this position. It will be appreciated that when the locking sleeve 16 is in the unlocked state, the lifting dogs 14 can be pivoted toward or away from each other to selectively capture or release a spearhead point.

In order to switch the locking sleeve 16 to the locked state, the sleeve 16 is gripped either by hand or by a tool and rotated through 90°. As this occurs, the locking balls 50 are pushed inwardly against the bias of the spring 48 rolling out of holes 72, and the wall 60 moves behind or inside the ends 56 being accommodated within the rebates 58. When turned fully for 90°, the holes 70 register with the holes 40 allowing the locking balls 50 to be pushed by the spring 48 partially into the holes 70 thereby holding the locking sleeve 16 in the locked state. When in this state, the ends 18 of the lifting dogs 14 can not be pivoted away from each other from the latched position to the release position. This direction of pivoting of the lifting dogs 14, if allowed, would be characterised by the ends 56 being pivoted toward each other against the bias of spring 62. However because the wall 60 is disposed within the rebates 58, the lifting dogs 14 can not be pivoted in this direction. Thus, a spearhead point captured by the lifting dogs 14 is positively locked and can not be released (except for a materials failure) until the locking sleeve 16 is again switched to the unlocked state.

Figure 4:
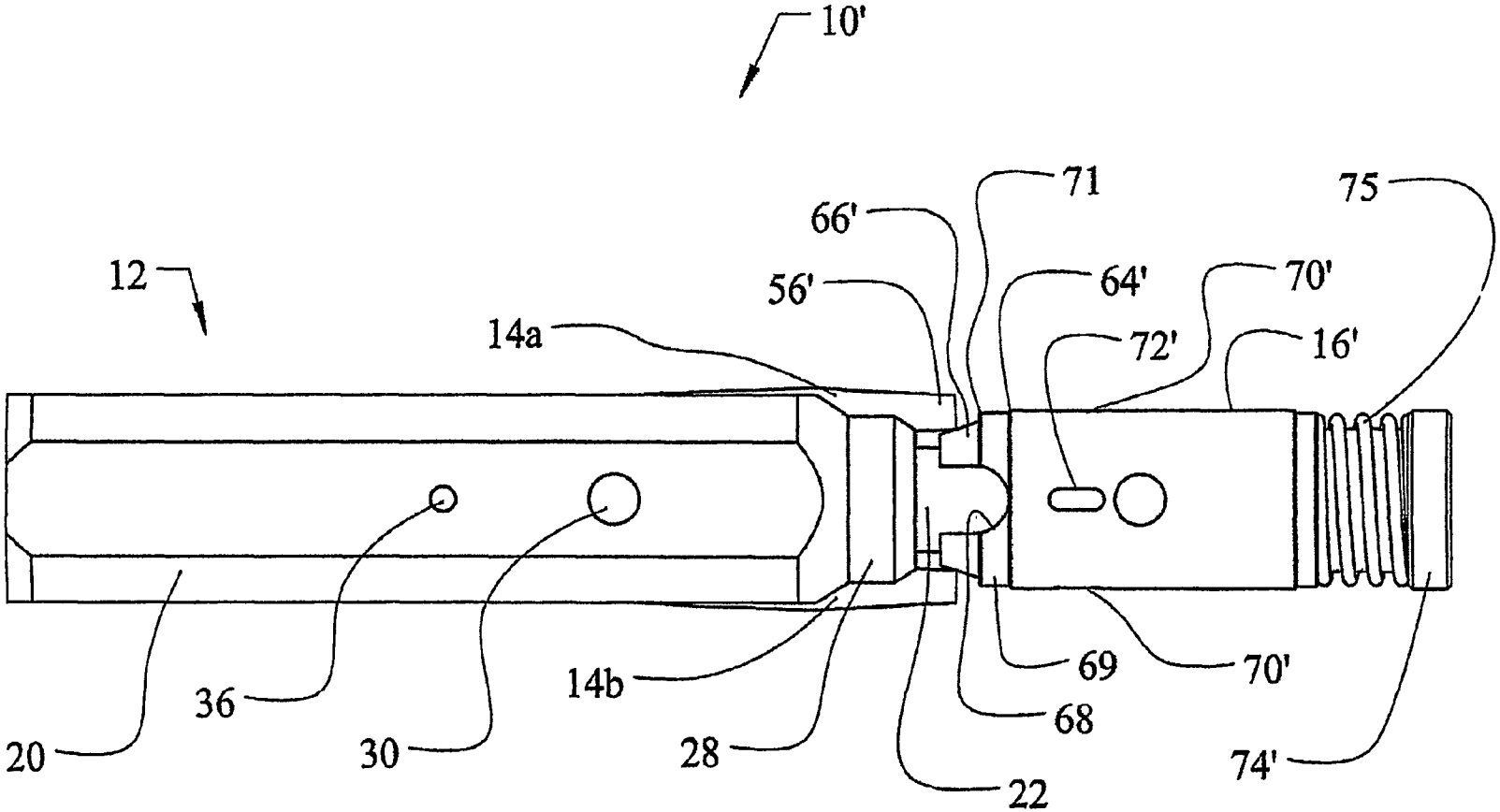

FIG. 4 depicts a second embodiment of the lockable overshot 10'. In this embodiment, like reference numbers are used to denote like features with the features which differ from the first embodiment being denoted with the addition of a prime symbol. The lockable overshot 10' includes an elongated body 12 of identical configuration and operation to that described in relation to the overshot 10 depicted in FIGS. 1–3. The salient differences between the lockable overshot 10' and the lockable overshot 10 are as follows. In the overshot 10' the ends 56' of the lifting dogs 14*a*, and 14*b* are not provided with the recess 58 depicted in FIG. 1. Further, the locking sleeve 16' has been reconfigured. In particular, the holes 70, and 72 of the first embodiment have been replaced with axially extending elongated slots 70' and 72'. As with the previous embodiments, these slots are disposed so as to partially receive the locking balls 50 when the locking sleeve 16' is in the locked state and unlocked state respectively. The slots 70' and 72' are of a circumferential width smaller than the diameter of the locking balls to ensure that they cannot escape therefrom. However, the provision of the slots 70' and 72' allows the sleeve 16' to also slide axially along the upper portion 22 of the body 12. Further, an end of the sleeve 16' adjacent the lifting dogs 14 has been reconfigured so that the tapered surface 64' has been replaced with a stepped surface which leads to a shoulder 69 of constant diameter which in turn steps down at edge 71 to circumferential wall 66'. The wall 66' is tapered so as to reduce in outer diameter in a direction toward the lifting dogs 14.

The retaining sleeve 74 of the first embodiment is now replaced with a bush 74' having a tubular body with an increased diameter head, and is attached to the end of the upper portion 22 distant the lower portion 20 by any conventional means (not shown). A spring 75 is located over the tubular body of the bush 74' seated between the locking sleeve 16' and the increased diameter head of the retaining bush 74'. The tubular body of the retaining bush provides an upper limit to the sliding motion of the locking sleeve 16'

By virtue of the taper of the wall section 66', the provision of slots 70' and 72' and spring 75, the sleeve 16' is able to slide axially along the body 12 as well as rotate about the axis of the body 12. When the locking sleeve 16' is in the position as depicted in FIG. 4, the wall 16' is disposed inside the ends 56' of the lifting dogs 14. The locking balls 50 (not shown in FIG. 4) extend partially into the slots 70' and act as a détente to assist rotational motion of the locking sleeve 16'. The spring 75 biases the locking sleeve 16' axially toward the lifting dogs 14 so that the wall 66' abuts against the inside of the ends 56'. This effectively prevents the first ends of the lifting dogs 14 from pivoting away from each other to release a previously captured spearhead point.

By rotating the locking sleeve 16' through ninety degrees so that the locking balls 50 register with the slots 72', the sleeve 16' is switched to the unlocked state where the ends 56' are located within respective gaps 68. This corresponds with the unlocked state where the first ends 18 of the lifting dogs 14 can be pivoted away from each other.

By providing a taper on the wall 66', which terminates at edge 71 of the shoulder 69, the locking sleeve 16' also provides a visual indication of the wear of the lifting dogs 14. As the lifting dogs 14 wear, the wall section 66' is able to be pushed further in the axial direction by the springs 75 thereby reducing the distance between the ends 56' and the shoulder 69, when the locking sleeve 16' is in the locked state. The diameter of the wall section 66' adjacent the edge 71 can be produced to a specific diameter which, when adjacent the ends 56' provides an indication that the lifting dogs 14 are worn out and should be replaced.

Now that an embodiment of the present invention has been described in detail it will be apparent to those skilled in the relevant arts that numerous modifications and variations may be made without departing from the basic inventive concepts. For example, the retaining member 74 may be attached to the body 12 by means other than the spring pins 52 and 54, for example by use of a bolt or by way of screw threaded engagement between the sleeve 74 and upper portion 22. Also, other forms of mechanism other than the détente system formed by the spring 48 locking balls 50 and holes 70, 72 can be used to releasably hold the locking sleeve 16 in the locked or unlocked states. Additionally, the lower portion 20 of the body 12 can be made of a transverse section other than octagonal, for example, circular, square or hexagonal. All such modifications and variations are deemed to be within the scope of the present invention, the nature of which is to be determined from the above description.

What is claimed is:

1. A lockable overshot including at least:

an elongated body;

at least two lifting dogs pivotally mounted to said body, said lifting dogs having respective first ends configured for latching a spearhead point therebetween, said first ends being pivotally moveable toward each other to a latched position wherein a spearhead point is latched therebetween and are pivotally moveable away from each other to a release position where a latched spearhead point is released; and, a locking sleeve retained movably on said body and switchable, by movement over the body between: a locked state where said locking sleeve locks said lifting dogs in said latched position and, an unlocked state where said locking sleeve allows said lifting dogs to move to said release position, said locking sleeve being rotatably retained on said elongated body and switched between said locked state and said unlocked state by rotating said locking sleeve about a longitudinal axis of said elongated body.

2. The lockable overshot according to claim 1 wherein said lifting dogs have respective second ends opposite said first ends and said lifting dogs are pivotally mounted at a location intermediate said first and second ends to said elongated body, and at least a portion of said locking sleeve is disposed inside said second ends when in said locked state.

3. The lockable overshot according to claim 1 wherein said locking sleeve is provided at one axial end with a circumferential wall formed with a gap for each of said lifting dogs wherein when in said locked state said wall is located inside said respective second ends and when in said unlocked state said second ends are located in said gaps.

4. The lockable overshot according to claim 3 wherein said lockable overshot further includes détente means for releasably holding said locking sleeve selectively in said locked and unlocked states.

5. The lockable overshot according to claim 4 wherein said détente means includes a biased locking ball extending from an outer surface of said elongated body and first and second recesses are formed in said locking sleeve for partially receiving said locking ball, said first recess being disposed to register with said locking ball when said locking sleeve is in said locked state and said second recess is disposed to register with said locking ball when said locking sleeve is in said unlocked state.

6. The lockable overshot according to claim 5 wherein said circumferential wall is of a constant outer diameter.

7. The lockable overshot according to claim 5 wherein said circumferential wall is formed with a reducing outer diameter in a direction toward said lifting dogs.

8. The lockable overshot according to claim 7 wherein said lockable overshot further includes bias means for biasing said locking sleeve axially in a direction toward said lifting dogs.

9. The lockable overshot according to claim 8 wherein said first and second recesses are in the form of axially extending slots.

10. The lockable overshot according to claim 9 wherein said locking sleeve is further provided with a shoulder of constant outer diameter adjacent said circumferential wall on a side distant said lifting dogs.

11. A lockable overshot including at least:

an elongated body;

at least two lifting dogs pivotally mounted to said body, said lifting dogs having respective first ends configured for latching a spearhead point therebetween, said first ends being pivotally moveable toward each other to a latched position wherein a spearhead point is latched therebetween and pivotally moveable away from each other to a release position where a latched spearhead point is released;

a locking sleeve retained movably on said body and switchable relative to said body between: a locked state where said locking sleeve locks said lifting dogs in said latched position and, an unlocked state where said locking sleeve allows said lifting dogs to move to said release position; and détente means for releasably holding said locking sleeve selectively in said locked and unlocked positions.

12. The lockable overshot according to claim 11 wherein said détente means includes a biased locking ball extending from an outer surface of said elongated body and first and second recesses formed in said locking sleeve for partially receiving said locking ball, said first recess being disposed to register with said locking ball when said locking sleeve is in said locked state and said second recess is disposed to register with said locking ball when said locking sleeve is in said unlocked state.

* * * * *